254-327 350/350 SR
12/9/80 XR 4,238,116

United States Patent [19]

Plante et al.

[11] 4,238,116

[45] Dec. 9, 1980

[54] SKIDDER JACK

[76] Inventors: Jacques F. Plante; Robert A. Plante, both of 11846 Tecumseh, Ontario, Canada, N8N 1L7

[21] Appl. No.: 51,894

[22] Filed: Jun. 25, 1979

[51] Int. Cl.[3] ..... B66D 3/00

[52] U.S. Cl. ..... 254/400; 254/327

[58] Field of Search ..... 254/166, 190 R, 139.1, 254/48, 64, 4 R, 134.3 R, 134.3 PA; 242/86.5 R, 95; 414/571, 569, 538, 559

[56] References Cited

U.S. PATENT DOCUMENTS

| | | | |
|---|---|---|---|
| 2,949,279 | 8/1960 | Eitel | 254/190 R |
| 3,762,584 | 10/1973 | Peterson | 254/166 X |
| 3,899,093 | 8/1975 | Allen | 254/166 X |
| 3,946,991 | 3/1976 | Eriksson | 254/166 |
| 4,127,295 | 11/1978 | Robinson | 254/166 |

*Primary Examiner*—John M. Jillions
*Attorney, Agent, or Firm*—Allen D. Gutchess, Jr.

[57] ABSTRACT

This invention consists of a front and rear lift mechanism or jack for lifting bogged down wheels of a skidder from ruts in the ground. It consists of a front and rear bracket each of which is equipped with a plurality of horizontal and vertical rollers which guide a cable from a winch on the skidder, away from the framework and body of the skidder when the cable is tied to a tree in the process of raising the bogged down skidder from the ruts in which it is stuck.

4 Claims, 6 Drawing Figures

SKIDDER JACK

This invention relates to front and rear lift mechanism or jacks for machines used in the handling of logs in the forest where they are first cut. These machines are actually heavy duty tractors specially designed for dragging logs from the areas where they are first cut to the storage area for their next stage of transportation. They are commonly referred to as "Skidders".

The terrain upon which the skidders operate is usually virgin ground covered with deep layers of snow in the winter and is wet and soggy in the spring and summer. The skidder, which is a very heavy tractor, quite often becomes stuck in the ground, and it becomes necessary to pull it out of the rut before it can continue to operate. Because of the weight of the skidder and the nature of the ground, conventional jacks have been found inoperative.

The usual procedure employed in raising a skidder out of a rut consists of using a heavy cable from a winch on the skidder, which passes under its frame and the end of which is then tied to the nearest suitable tree. By rewinding the winch, the stuck end of the skidder is pulled and raised, at the same time, and released from the rut.

This method is very effective; however, it is very costly in material, labor, and lost time, because quite often the cable which is at times three quarters of an inch in diameter becomes damaged or breaks due to its contact with the skidder frame under an extremely high tension. This involves the replacement of the cable, labor cost, and the loss of valuable time.

The primary object of this invention is therefore to eliminate the contact of the cable with any sharp edges, thereby eliminating the damage to the cable and all other expenses involved.

In describing the invention reference will be made to the attached drawings in which.

Figure 3:
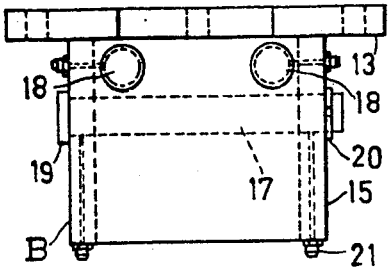
FIG. 3, is a plan view of the front skidder jack.
Figure 1:
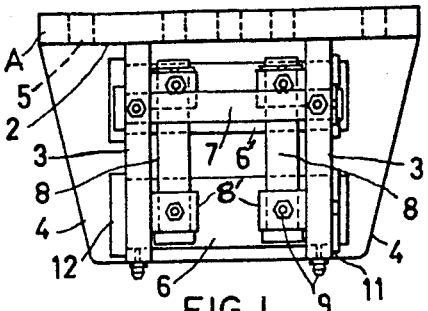
FIG. 1, is a plan view of the rear skidder jack.
Figure 4:
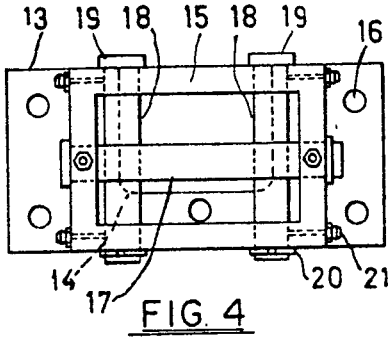
FIG. 4, is a front elevation of the front skidder jack.
Figure 2:
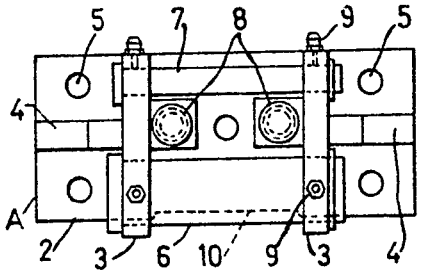
FIG. 2, is a front elevation of the rear skidder jack.

A rear jack A is made of heavy steel plate, preferably of three quarters inch thickness. It consists of a rectangular back plate 2, from the face of which extend at right angles two spaced shorter plates 3, which are located symmetrically about the center of the plate 2. A brace 4 is provided between the back plate 2 and each of the extensions 3. The plate 2 is also provided with a plurality of bolt holes 5 by means of which the rear jack A is attached to the bottom framework or body of a skidder 22. At the front and bottom of the plates 3, is located a roller 6 which is parallel to the back plate 2, and is free to rotate within the plates 3. A similar roller 6' is spaced from the roller 6, parallel, and in line with it at the rear of the plates 3. Two side rollers 8 are each attached to the inner faces of the plates 3 and are free to rotate within their supporting blocks 8'. They are smaller in diameter and spaced from and at right angles to the rollers 6 and 6'. An upper rear roller 7, smaller in diameter than the roller 8, is spaced from, and at right angles to, the rollers 8. The rollers 6, 6', 7, and 8 are held within their supports by a circular boss 12 and a retaining ring 11, and are provided with lubrication fittings 9. The back plate 2 is provided with an indentation 10 for the purpose of clearing the cable 24, as will be described in connection with FIG. 6.

A front jack B consists of a back plate 13 to which is centrally attached a rectangular box 15 which has an open face and an open back. Centrally located on the back plate 13 is a U-shaped cut out area 14 to permit the passage therethrough of a cable 24 (see FIG. 6). Holes 16 are provided in the back plate 13 for attaching the jack B to the skidder. A centrally located horizontal roller 17 rotates freely in the box 15, and a vertical free rotating roller 18 is located at the rear of and close to each vertical side of the box 15. The rollers 17 and 18 are held within the box 15 by bosses 19 and retaining rings 20, and the rollers are lubricated by lubrication fittings 21.

Figure 5:
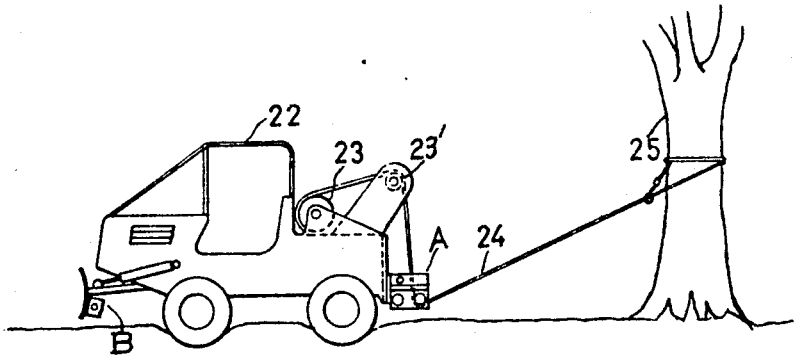
FIG. 5 is a diagram showing the method of applying the rear jack.

FIG. 5 shows the procedure for freeing the rear wheels of the skidder 22 from a rut 27. The skidder is equipped with a power operated winch 23 and a winch idler roller 23' located away from and above the winch. The cable 24 which is normally wound upon the winch runs over the idler 23', down to and between the jack rollers 6 and 6', wraps under and against the roller 6, and continues on to be tied to the nearest available tree 25 as shown. By rotating the winch in the pulling direction, the cable is tightened, thus raising the skidder and its rear wheels out of the rut.

Figure 6:
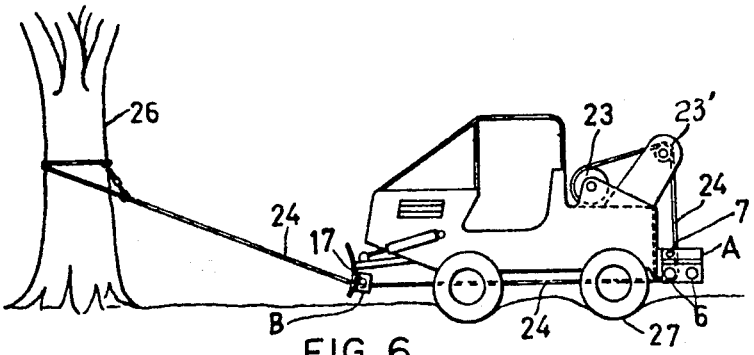
FIG. 6, is a diagram showing the application of the front jack.

FIG. 6 shows the method of freeing the front wheels when they are bogged down. In this case, the cable 24 from the idler 23' goes down between the rollers 6 and 6' and wraps under and against the roller 6' and also against the roller 7. The cable 24 then runs under the skidder to the roller 17 in the front jack B. It presses tightly against the bottom of the roller 17 and is tied to the nearest available tree 26. By activating the winch, the front of the skidder with its wheels are raised out of the rut.

The vertical rollers 8, in the jack A and the vertical rollers 18, in the jack B serve the purpose of having the cable 24 rub against them when the tied cable is at an angle to the skidder.

This invention besides acting as a jack as above described, can also be used for dragging a number of cut logs along a rugged ground by tying the ends of the logs to the cable, along its length, or for pulling large structures for relocation. As a safety feature, the use of this invention eliminates cable burn to the hands of workmen on the job.

Various modifications of the above described embodiment of the invention will be apparent to those skilled in the art, and it is to be understood that such modifications can be made without departing from the scope of the invention, if they are within the spirit and the tenor of the accompanying claims.

We claim:

1. A pair of lift mechanisms for lifting the wheels of a bogged down vehicle equipped with a winch having a cable wound thereon, said pair comprising a rear lift mechanism having a frame provided with fastening means to attach the frame to the back of the vehicle, two spaced, generally parallel and horizontal rear rollers having ends supported by said frame, one of said rear rollers raising the rear of the vehicle when the winch cable is passed thereunder and is taut, and two spaced, generally parallel guide means for guiding the winch cable carried by said frame and spaced from and at right angles to said rear rollers; said pair further comprising a front lift mechanism having a second frame with fastening means to attach the second frame to the front of the vehicle, a generally horizontal front roller having ends carried by said second frame and positioned generally parallel to said rear rollers, said front roller and the other of said rear horizontal rollers raising the front of said vehicle when the hoist cable is passed under the other of said rear horizontal rollers and under said front horizontal roller and is taut, and two front guide means carried by said second frame and spaced from said horizontal roller for guiding the winch cable.

2. A pair of lift mechanisms according to claim 1 characterized by said frame of said rear lift mechanism having a longitudinally-extending indentation along the bottom edge thereof for receiving the winch cable.

3. A pair of lift mechanisms according to claim 1 characterized by said frame of said front lift mechanism having a U-shaped indentation in the upper edge thereof for receiving the winch cable.

4. A pair of lift mechanisms according to claim 1 characterized by a top roller located above said rear rollers and to the rear thereof.

* * * * *